US010550562B2

(12) United States Patent
Boxum

(10) Patent No.: US 10,550,562 B2
(45) Date of Patent: Feb. 4, 2020

(54) INSPECTION CHAMBER FOR A PIPE STRUCTURE FOR DRAINAGE OR SEWERAGE

(71) Applicant: Wavin B.V., CW Zwolle (NL)

(72) Inventor: Silas Rudolf Boxum, Zwolle (NL)

(73) Assignee: Wavin B.V., Zwolle (NL)

( * ) Notice: Subject to any disclaimer, the term of this patent is extended or adjusted under 35 U.S.C. 154(b) by 11 days.

(21) Appl. No.: 15/766,721

(22) PCT Filed: Oct. 7, 2016

(86) PCT No.: PCT/EP2016/074003

§ 371 (c)(1),
(2) Date: Apr. 6, 2018

(87) PCT Pub. No.: WO2017/060429

PCT Pub. Date: Apr. 13, 2017

(65) Prior Publication Data

US 2018/0291609 A1 Oct. 11, 2018

(30) Foreign Application Priority Data

Oct. 7, 2015 (NL) ..... 1041505

(51) Int. Cl.
*E03F 5/02* (2006.01)
*E03F 5/00* (2006.01)
*E03F 3/04* (2006.01)

(52) U.S. Cl.
CPC ..... *E03F 5/027* (2013.01)

(58) Field of Classification Search
CPC ..... E03F 5/027; E03F 5/024
(Continued)

(56) References Cited

U.S. PATENT DOCUMENTS 530,816 A * 12/1894 Wright ..... E02D 29/12 210/247
821,675 A * 5/1906 Shaw ..... E03F 5/02 404/4

(Continued)

FOREIGN PATENT DOCUMENTS

DE 1801180 U * 11/1959 ..... E03C 1/30
EP 83007 A1 * 7/1983 ..... E02D 29/12

(Continued)

OTHER PUBLICATIONS

International Search Report and Written Opinion for International Application No. PCT/EP2016/074003, dated Dec. 1, 2016.

(Continued)

*Primary Examiner* — Patrick J Maestri
*Assistant Examiner* — Joseph J. Sadlon
(74) *Attorney, Agent, or Firm* — Wolf, Greenfield & Sacks, P.C.

(57) ABSTRACT

Inspection chamber for a pipe structure for drainage or sewerage, the chamber having an inspection entrance at a first side for connecting up with an inspection shaft, the chamber further being provided with a feet-structure at a second side, the first side and the second side being opposite sides of the inspection chamber, the feet-structure comprising at least two feet which are in combination configured for: stabilizing the inspection chamber when positioned on a supporting ground in such a way that the inspection entrance is at an upper position, therewith hindering sideways falling of the inspection chamber; and maintaining the manufactured shape of the inspection entrance of another one of such an inspection chamber when the feet-structure is placed in a mating position with the inspection entrance of that other one of such an inspection chamber, for instance during storage and/or transport thereof; and of which each foot itself is configured for: resisting sinking of the inspection (Continued)

chamber into a sandy ground when positioned on such a sandy ground in such a way that the inspection entrance is at an upper position.

19 Claims, 5 Drawing Sheets

(58) Field of Classification Search
USPC ..... 52/19, 20; 405/41
See application file for complete search history.

(56) References Cited

U.S. PATENT DOCUMENTS 1,959,623 A * 5/1934 Gordon ..... E03F 5/0407 210/301
2,539,076 A * 1/1951 Harris ..... E02B 13/02 251/280
2,615,526 A * 10/1952 Lane ..... E03F 5/0404 210/164
3,346,230 A * 10/1967 Tolf, Jr. ..... E04G 15/061 174/37
3,391,791 A * 7/1968 Seney ..... E03F 5/0407 210/232
3,593,344 A * 7/1971 Logsdon ..... E04G 15/061 220/484
3,805,891 A * 4/1974 Reinhard ..... E21B 33/00 166/85.2
3,856,679 A * 12/1974 Jackson ..... E04H 4/1272 210/471
4,247,395 A * 1/1981 Halishak ..... B01D 21/0012 210/744
4,346,921 A * 8/1982 Gill ..... E02D 29/12 285/110
4,460,462 A * 7/1984 Arneson ..... E04H 4/1236 210/163
4,960,227 A * 10/1990 Coleman ..... B65D 77/061 222/105
5,341,523 A * 8/1994 Barnes ..... E03F 5/0407 137/362
5,405,539 A * 4/1995 Schneider ..... B01D 29/07 210/163
5,535,908 A * 7/1996 Sheu ..... B65D 21/08 206/509
5,902,477 A * 5/1999 Vena ..... E03F 5/12 210/106
5,904,842 A * 5/1999 Billias ..... E03F 5/0401 210/162
6,337,025 B1 * 1/2002 Clemenson ..... B01J 20/22 210/163
6,478,954 B1 * 11/2002 Turner, Jr. ..... B01D 35/02 210/162
6,537,447 B2 * 3/2003 Remon ..... B01D 29/03 210/163
7,011,743 B2 * 3/2006 Use ..... B01D 21/0012 210/131
7,458,749 B2 * 12/2008 Dickie ..... E03F 1/003 405/157
7,627,992 B1 * 12/2009 Gavin ..... E02D 29/12 174/39
7,722,763 B2 * 5/2010 Benty ..... B01D 21/0012 210/162
7,774,988 B2 * 8/2010 Guitoneau ..... E02D 29/124 52/20
7,837,869 B2 * 11/2010 Peters, Jr. ..... B01D 39/083 210/164
8,715,507 B2 * 5/2014 Gulliver ..... E03F 5/14 210/170.03
9,340,988 B2 * 5/2016 Lyristakis ..... E04H 4/1236
9,359,764 B2 * 6/2016 Andersson ..... E04C 5/20
2004/0040221 A1 * 3/2004 Airheart ..... E02D 29/12 52/20
2005/0025573 A1 * 2/2005 Waldman ..... E02B 13/02 405/41
2006/0239780 A1 * 10/2006 Cawte ..... E02D 29/12 405/184.1
2016/0214275 A1 * 7/2016 Muller ..... E21B 33/00 166/85.2

FOREIGN PATENT DOCUMENTS

EP 1956153 A1 * 8/2008 ..... E03F 5/02
FR 2509343 A1 * 1/1983 ..... E03F 5/02
FR 2560904 A1 * 9/1985 ..... E02D 29/12
WO WO 2015/011294 A1 1/2015

OTHER PUBLICATIONS

International Preliminary Report on Patentability for International Application No. PCT/EP2016/074003, dated Apr. 19, 2018.

* cited by examiner

INSPECTION CHAMBER FOR A PIPE STRUCTURE FOR DRAINAGE OR SEWERAGE

CROSS-REFERENCE TO RELATED APPLICATIONS

This Application is a national stage filing under 35 U.S.C. 371 of International Patent Application Serial No. PCT/EP2016/074003, filed Oct. 7, 2016, which claims priority to Netherlands application number 1041505, filed Oct. 7, 2015, the disclosures of which are incorporated by reference herein in their entireties.

INTRODUCTION

The invention relates to an inspection chamber for a pipe structure for drainage or sewerage, also referred to as sewage. Such inspection chambers, if big enough, may also be referred to as manholes, or other access junctions which facilitate inspecting drainage or sewerage systems, by equipment, by a worker, or by both.

Drainage and sewerage systems generally include underground pipes which, through use, are prone to becoming blocked or damaged. As pipes may run for a considerable distance underground, it is desirable to provide access to the pipes at various positions, and particularly where a pipe is joined to one or more other pipes. Such access is provided by what is referred to as an "inspection chamber". In this disclosure, the term inspection chamber may cover manholes, access junctions and similar products which provide access to sewerage or drainage systems. As the drainage and sewerage systems are generally placed underground, the inspection chamber is normally positioned such that an entrance of the chamber for inspecting, i.e. for letting equipment and/or a worker into the chamber, is positioned at an upper position.

During installation of the inspection chamber in an underground infrastructure such as a pipe structure, there may be a timeframe during which the inspection chamber is positioned in a hole made in the ground, waiting for being connected up with pipes to form part of the infrastructure. It is also possible that the inspection chamber is placed on the ground in an area that is meant to be filled up by soil material. In the timeframe before becoming part of the infrastructure, the inspection chamber will at some stage, as a stand-alone, maintain an upright position, so that the inspection entrance is at an upper position. For ensuring that the inspection chamber can freely stand in that upright position it may be provided with a foot, for instance as described in DE 203 13 762 U1. The foot is according to that prior art document preferably at a position that coincides with a centre of gravity of the inspection chamber, preferably comprises a base plate and is preferably such that the weight of the inspection chamber can via the foot be supported by the ground in the hole. The foot will at some stage be surrounded by and/or embedded in soil-material that is used for filling the hole, therewith anchoring the inspection chamber.

Going back to a period in the existence of the inspection chamber before placement of the inspection chamber on the ground in a hole or in an area that will be filled up with soil material, the inspection chamber experiences after its production a period of storage and of transport from a storage site (which may also be an inspection chamber production site) to its destination. Such transport is likely to be such that many parts of the pipe infrastructure are efficiently transported. This is especially important as, by their very nature, pipe infrastructure parts are hollow, so that transport often entails densely packing the parts so as to transport as many parts as possible per volume. However, such densely packing may have the undesired effect of deformation of parts.

The costs of an inspection chamber are for a great deal set by the amount of material needed for making an inspection chamber. Hence inspection chamber designs are often the result of optimising strength and stiffness against a minimum of material needed for the design.

WO 2015/011294 describes a stacking aid for inspection chambers for use in drainage or sewage systems to allow stable stacking of the inspection chambers. The stacking aid comprises at least one support configured to extend from an exterior surface of a first inspection chamber into an interior of a second chamber and/or adjacent to an exterior surface of a wall defining the interior, or the entrance opening, of the second inspection chamber, to thereby reduce movement of the first and second inspection chambers relative to each other in a direction perpendicular to the direction of stacking. Also an assembly of an inspection chamber stacking aid and an inspection chamber is described.

There is a need for an inspection chamber that can stably be positioned with the inspection entrance at an upper position, that allows for densely packing the inspection chambers and that will also in terms of its positioning in vertical direction be stable, whilst keeping costs of producing the inspection chamber relatively low.

SUMMARY OF THE INVENTION

According to one aspect there is provided an inspection chamber for a pipe structure, for drainage or sewage. The chamber has an inspection entrance at the first side for connecting up an inspection shaft. The chamber is further provided with a feet-structure at the second side. The first side and the second side are opposite sides of the inspection chamber. The feet-structure comprises at least two feet which are in combination configured for:

- stabilizing the inspection chamber when positioned on a supporting ground in such a way that the inspection entrance is at an upper position, therewith hindering sideways falling of the inspection chamber; and
- maintaining the manufactured shape of the inspection entrance of another one of such an inspection chamber when the feet structure is placed in a stacking position with the inspection entrance of that other one of such an inspection chamber, e.g. during storage and/or transport thereof; and of which each foot itself is configured for:
- resisting pressing or sinking of the inspection chamber into a sandy ground when positioned on such a sandy ground in such a way that the inspection entrance is at an upper position.

Having configured the feet-structure such that it can carry out these three independent functions, the overall performance of the inspection chamber is improved and only a minimum, if any at all of additional material is used for making such an improved inspection chamber.

According to another aspect, there is provided an inspection chamber for a pipe structure for drainage or sewage. The chamber has an inspection entrance at a first side for connecting up an inspection shaft. The chamber is further provided with a feet structure at a second side. The first side and the second side are opposite sides of the inspection chamber. The inspection chamber comprises between the feet structure and the inspection entrance a pipe part, and between the pipe part and the opening a compartment that is formed by wall portions which extend from the pipe part to the entrance opening. The chamber is further provided with stiffening portions which form a direct connection between the feet structure and the wall portions.

Such a direct connection ensures that forces exerted on the feet structure and/or on the wall portions, are not all passed on to the pipe part. If forces were to be passed onto the pipe part, then these would possibly affect a deformation of the pipe part to an extent that the flow pattern of a fluid running through the pipe part is disturbed up to an undesired extent. Ideally, the stiffening portions bypass the pipe part. It may still be possible that the stiffening portions are connected to an outer wall of the pipe part, to facilitate easy manufacturing of the inspection chamber. However, when the stiffening portions are considered to bypass the pipe part, forces exerted on the feet structure and/or the wall portions, forming a compartment in the inspection chamber that is different to the pipe part, are only passed on to the pipe part, if at all, up to an extent that these forces do not lead to a noticeable effect in the flow pattern of a liquid running through the pipe part.

According to a further aspect there is provided a stack of at least two inspection chambers for a pipe structure for drainage or sewage. Each chamber has in a first side of the respective inspection chamber an inspection entrance for connecting up an inspection shaft. Each inspection chamber is at a second side of the respective inspection chamber provided with a feet-structure. The first side and the second side are opposite sides. Each inspection chamber comprises between the feet-structure and the entrance opening a pipe part, and between the pipe part and the entrance opening a compartment that is formed by wall portions which extend from the pipe part to the entrance opening. The inspection chamber is further provided with stiffening portions which form a direct connection between the feet structure and the wall portions. The feet structure of one of the at least two inspection chambers is in a mating position with the inspection entrance of another one of the at least two inspection chambers. The feet-structure comprising at least two fee which in combination are configured for maintaining the manufacturing shape of the inspection entrance of that another one of the at least two inspection chambers. Preferably, the stiffening portions by-pass the pipe part.

According to another aspect, there is provided a stack of at least two inspection chambers for a pipe structure for drainage or sewage. Each chamber has at a first side of the respective inspection chamber an inspection entrance for connecting up an inspection shaft. Each inspection chamber is at the second side of the respective inspection chamber provided with a feet-structure. The first side and the second side are opposite sides. The feet-structure of one of the at least two inspection chambers is in a mating position with the inspection entrance of another one of the at least two inspection chambers. The feet-structure of each inspection chamber comprise at least two feet which in combination are configured for stabilizing the respective inspection chamber when supporting on a supporting ground in such a way that the inspection entrance is at an upper position, therewith hindering sideways falling of the inspection chamber. Each foot is configured for resisting sinking of the respective inspection chamber into a sandy ground when positioned on such a sandy ground in such a way that the inspection entrance is at an upper position.

Further embodiments and/or optimizations are discussed below in the description of the figures, without limiting the invention to the examples shown.

Embodiments are further disclosed and explained on the basis of the drawings, which show in:

In the drawing, like parts have like references.

Figure 1:
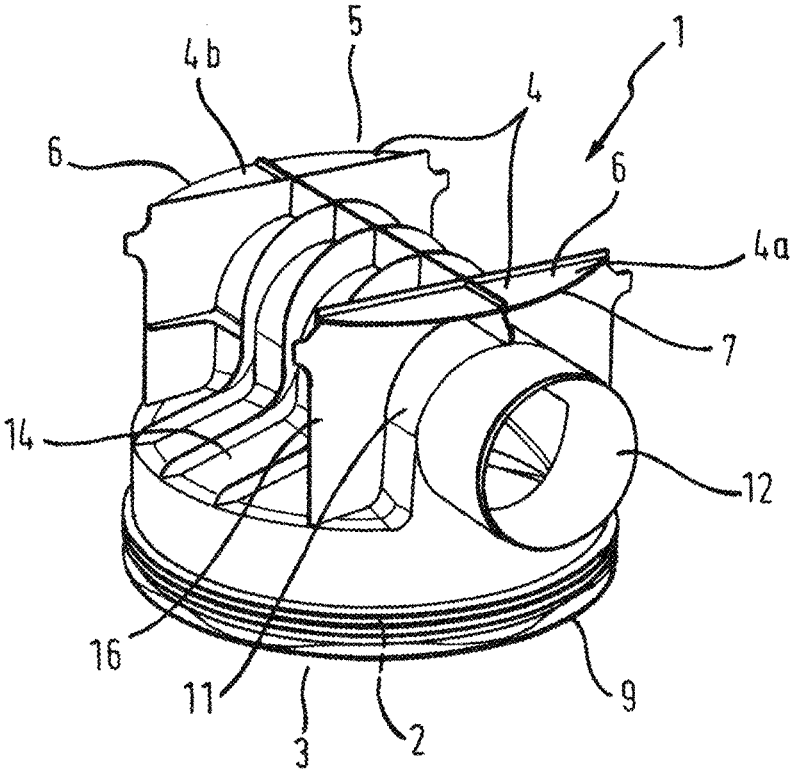
FIG. 1 shows an isometric view of an embodiment of an inspection chamber according to the invention, in an upside down position.
Figure 2:
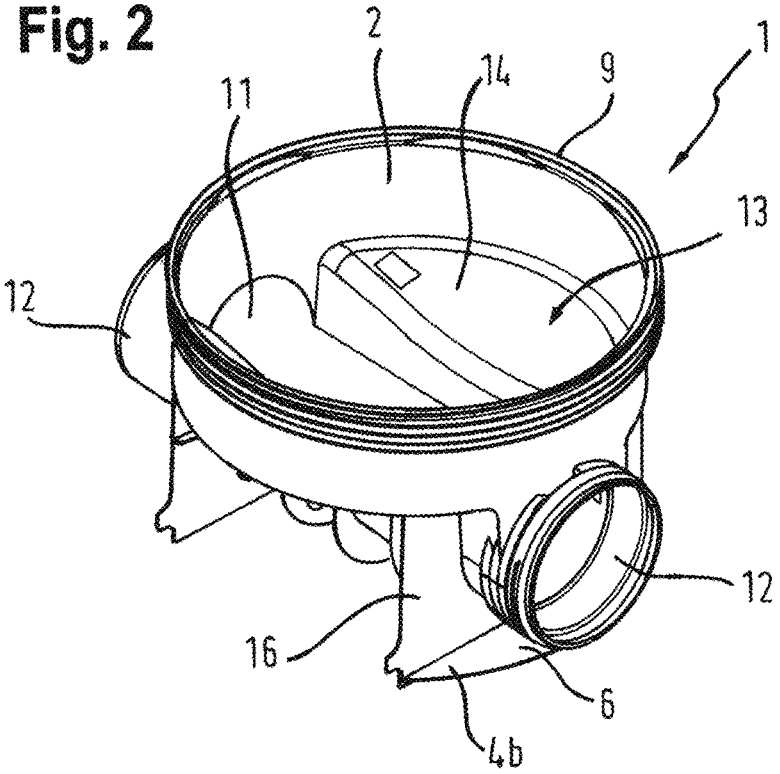
FIG. 2 shows an isometric view of an embodiment of an inspection chamber according to the invention, in a position in which the inspection entrance is at an upper position.

FIG. 1 shows an isometric view of an embodiment of an inspection chamber 1, in an "upside down" position. FIG. 2 shows an isometric view of that embodiment, in a position which the inspection chamber 1 would have if placed in a pipe structure for drainage or sewage. The inspection chamber 1 has an inspection entrance 2 at a first side 3 for connecting up with an inspection shaft (not shown). The chamber 1 is further provided with a feet-structure 4 at a second side 5. The first side 3 and the second side 5 are opposite sides of the inspection chamber 1. As FIG. 2 shows the position of the inspection chamber as it would have, i.e. in use; a position it would have underground, and inspection is likely to take place, it is clear that the inspection entrance should, as shown, be at an upper position. Consequently, the inspection chamber as shown in FIG. 1 is "upside down".

The feet-structure 4 comprises at least two feet 4*a*, 4*b*, which are in combination configured for:

stabilizing the inspection chamber 1 when positioned on a supporting ground in such a way that the inspection entrance is at an upper position.

This way of positioning the inspection chamber 1 corresponds to the position shown in FIG. 2, in which the inspection chamber is shown as having its feet-structure downwards. Clearly, this way of configuring the at least two feet 4*a*, 4*b* hinders sideways falling of the inspection chamber 1.

The two feet 4*a*, 4*b* are in combination also configured for maintaining the manufactured shape of the inspection entrance 2 of another one of such an inspection chamber 1, when the feet-structure 4 is placed in a mating position with the inspection entrance 2 of that other one of such an inspection chamber, for instance during storage and/or transport thereof.

Figure 3:
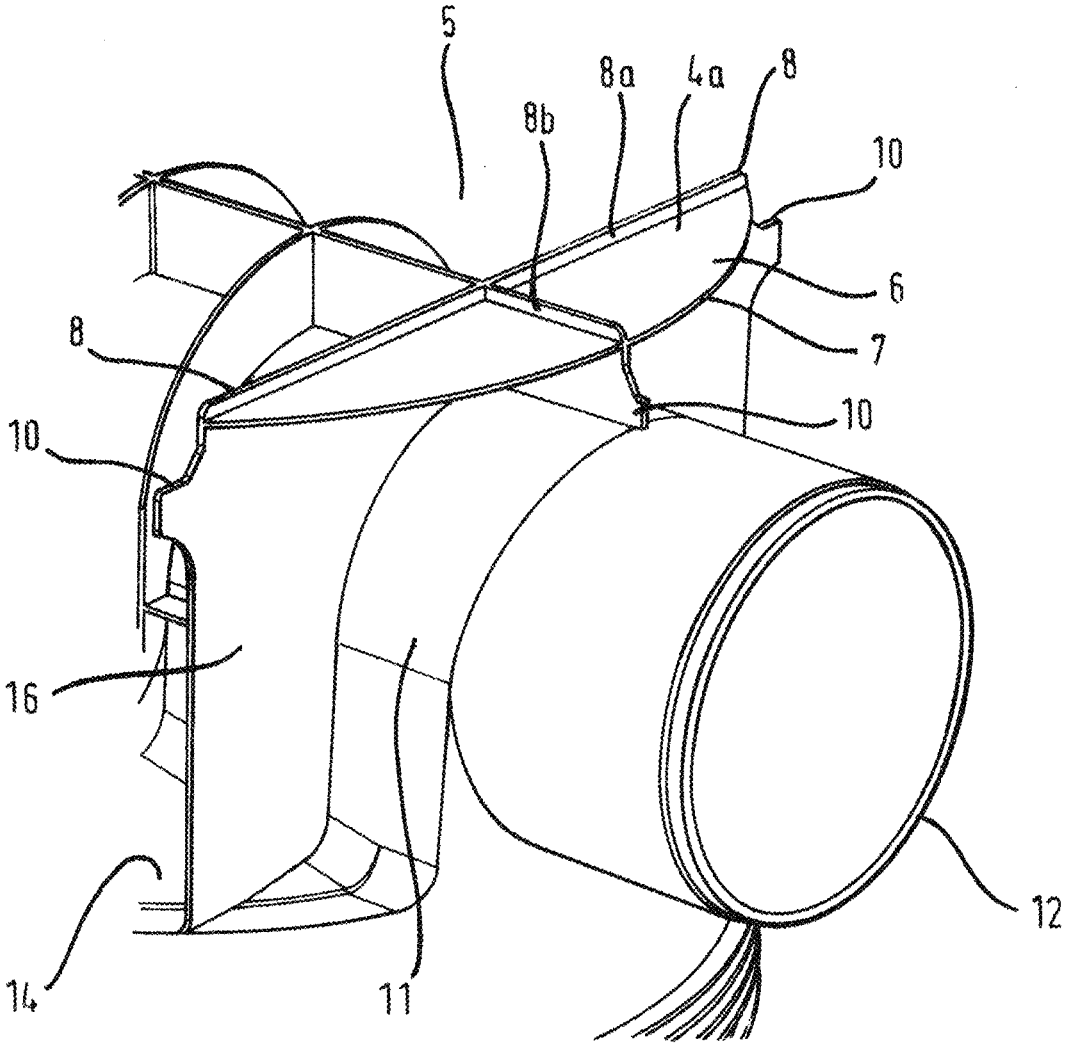
FIG. 3 shows an isometric view of a part of an embodiment of an inspection chamber according to the invention, in an upside down position.

FIG. 3 shows in more detail a part of an embodiment of an inspection chamber, in an upside down position, to reveal more details of the feet structure 4 and other features related to the functioning of the feet structure when two of such inspection chambers 1 are in a mating position.

Figure 4:
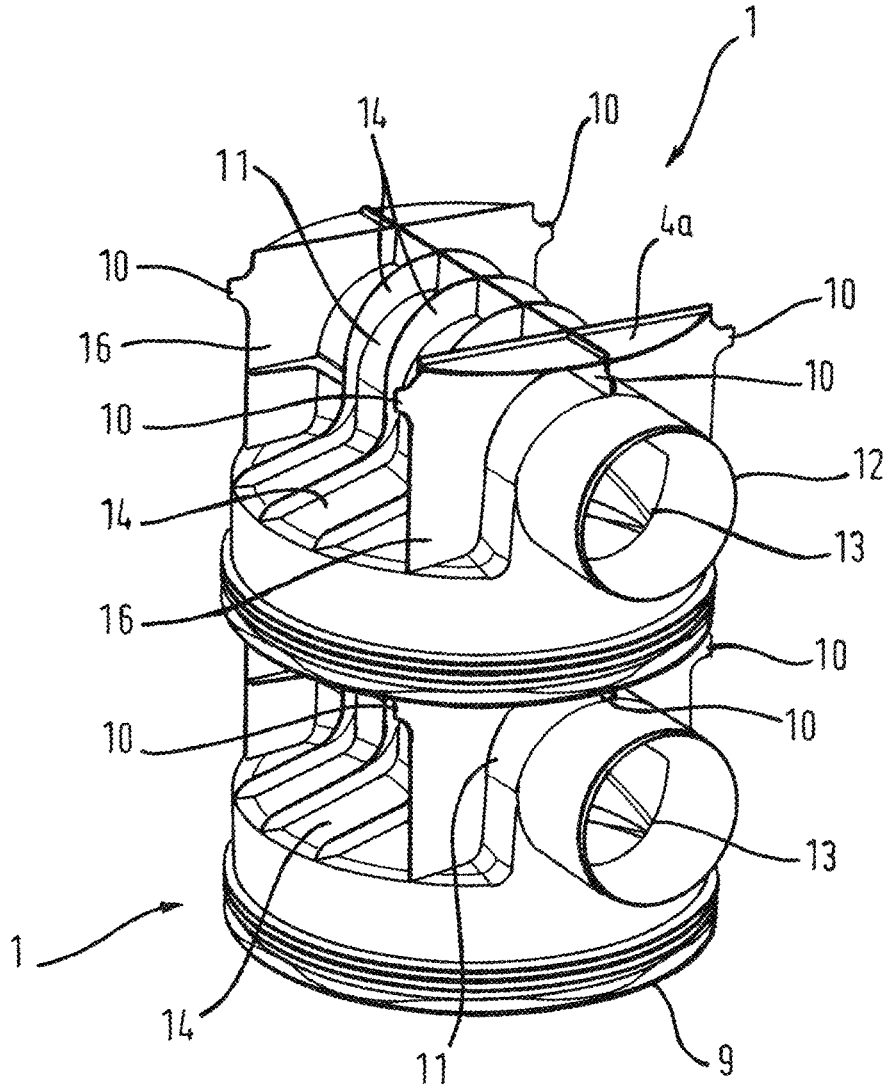
FIG. 4 shows in an isometric view two embodiments of an inspection chamber according to the invention, in a mating position, as well as an embodiment of a stack of two inspection chambers.

For the sake of providing further understanding of the invention, FIG. 4 shows two inspection chambers 1 in a mating position. Below more details and explanations will be given as to the functioning of the feet-structure 4 and other parts of the inspection chamber 1.

Each foot 4*a*, 4*b* itself is configured for resisting sinking of the inspection chamber 1 into a sandy ground when positioned on such a sandy ground in such a way that the inspection entrance 2 is at an upper position (shown in FIG. 2). Hereinafter, a position of the inspection chamber in such a way that the inspection entrance 2 is at an upper position, is also referred to as an "upright position".

Each foot 4*a*, 4*b* is, as much as it is configured for resisting sinking, equally configured for acting as an anchor when the inspection chamber and thus also the feet-structure is buried in the ground. This is particularly important when a relatively high level of groundwater causes the inspection chamber to be driven upwardly. Then the "anchor-function" of the feet 4*a*, 4*b* may start playing a role and provide a brake against the tendency to be driven upwardly.

Figure 5:
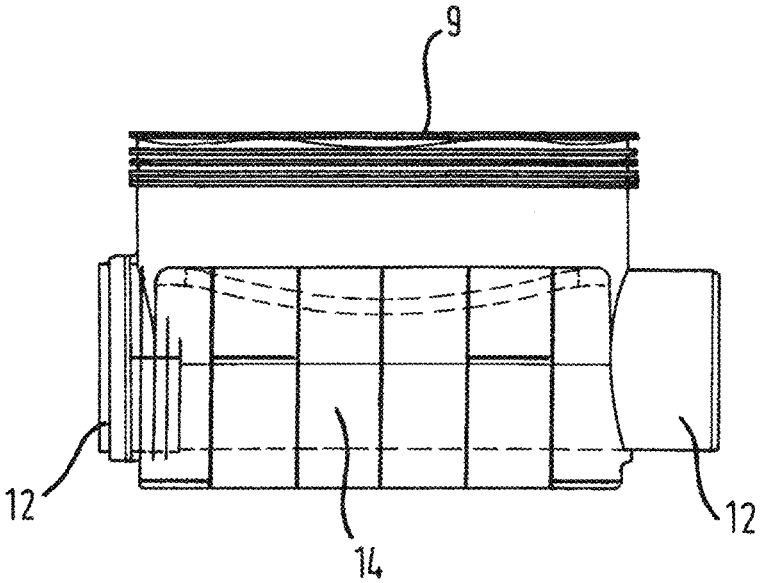
FIG. 5 shows a side view of an embodiment of an inspection chamber according to the invention.
Figure 6:
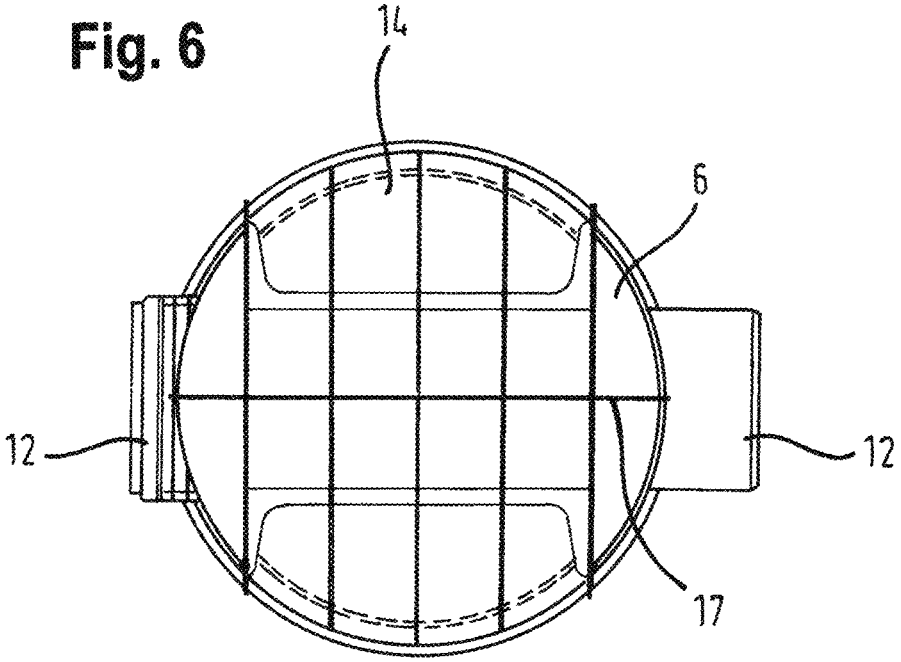
FIG. 6 shows a bottom view of an embodiment of an inspection chamber according to the invention.
Figure 7:
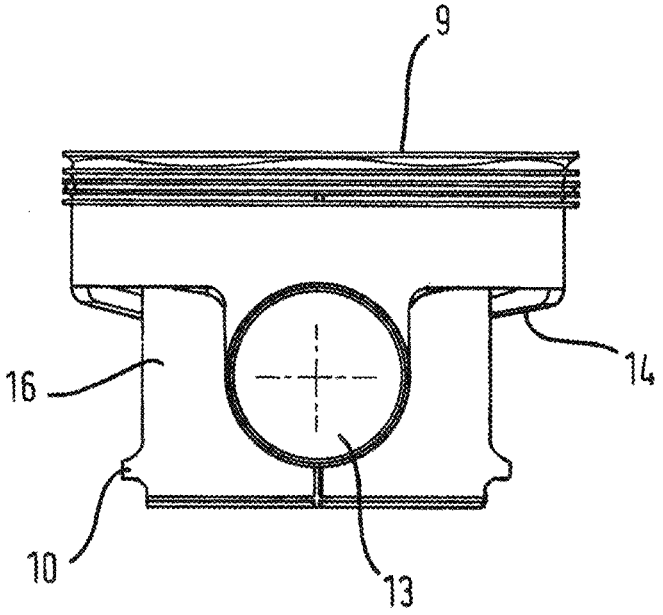
FIG. 7 shows another side view of an embodiment of an inspection chamber according to the invention.

Although not much reference will be made to FIGS. 5, 6 and 7, showing respectively a side view, a bottom view and another side view of an embodiment of an inspection chamber 1, the skilled reader will be able to more completely visualize how an embodiment of an inspection chamber 1 could look like.

Inspection entrance 2 for connecting up an inspection shaft (not shown) lies in an imaginary plane, and each of the feet 4*a*, 4*b* comprises a base plate 6 extending in a direction that is parallel to that imaginary plane. Each of the feet 4*a*, 4*b* comprises a base plate 6 extending in a direction that is across an axial direction of the entrance opening 2.

At least one of the base plates 6 extends over an area that corresponds to 5-40% of an area defined by the inspection entrance 2. A more optimal compromise in terms of stability, resistance to sinking in a sandy ground, capability of maintaining the manufactured shape of the inspection entrance of another one of such an inspection chamber when mating therewith, and the amount of material needed for providing the feet structure, is available when at least one of the base plates 6 extends over an area that corresponds to 8-18% of an area defined by the inspection entrance 2. Preferably each of the base plates extends over an area that corresponds to 8-18% of an area defined by the inspection entrance 2.

Each of the base plates 6 has an edge 7 that would cover a part of an inner periphery of the inspection entrance 2 of that other one of such an inspection chamber, when in mating position. The part of the periphery of the inspection entrance 2 that would be covered by an edge of the respective base plate 6 when a mating position applies, corresponds to at least 10-45% of the entire inner periphery of the inspection entrance 2. It has turned out that optimally, in terms of maintaining a manufactured shape of the inspection entrance 2 of another one when in mating position, and using a relatively low amount of material for the feet structure, the part of the periphery of the inspection entrance 2 that would be covered by an edge of the respective base plate 6 when a mating position applies, corresponds to 20-30% of the entire inner periphery of the inspection entrance 2.

Turning now to FIG. 3, it is pointed out that the feet 4*a*, 4*b* are each provided with at least one position holder 8 configured for resisting lateral movement in at least one direction from a position of the inspection chamber 1 in a sandy ground when the inspection chamber is positioned in "upright position". The position holder 8 is preferably configured to resist lateral movement in any direction. The term "position holder" thus refers to holding a position relative to the ground, i.e. in the plane of the ground, when the inspection chamber is placed in the upright position.

The embodiment shown in FIG. 3 has a part 8*a* extending in one direction and a part 8*b* extending in a direction perpendicular to the direction of part 8*a*. The position holder 8 comprises a blade-shaped part that extends in at least a direction which is parallel to an axial direction of the inspection entrance 2. The width of the blade is about 2-15 mm. The blade-shaped form is shown for part 8*a* as well as part 8*b*.

Focusing now in more detail onto the features that assist in the functioning of the feet-structure when the inspection chamber 1 is in a mating position, it is pointed out that the inspection entrance 2 comprises a rim 9. Inspection chamber 1 is further provided with a multitude of positions 10 for abutting the rim 9 of that another one of such an inspection chamber 1 when the feet-structure is placed in the mating position. As can more easily be seen in FIG. 4 showing a stack of two inspection chambers each in upside-down position and together in mating position, the positions 10 for abutting the rim 9 support the positioning of the upper inspection chamber. In the mating position, at least a part of the feet-structure is within the inspection entrance of that another one of such an inspection chamber. This can also be seen in FIG. 4. The feet-structure that is underneath the inspection chamber 1 of the other inspection chamber, cannot be seen as it is within the inspection entrance 2 of the other inspection chamber 1. The positions are distributed along an outer periphery of each base plate 6 so as to maximize the distance between those positions 10 along the rim 9 of that another one of such an inspection chamber 1 when the feet-structure is put in the mating position. This facilitates the function of maintaining the manufactured shape of the inspection entrance 2.

So far, not much attention has been given to a further optimization of the inspection chamber. The inspection chamber comprises between the feet-structure 4 and the inspection entrance 2 a pipe part 11. The chamber 1 may also have at least two pipe connection parts 12 which are each for connecting up with a pipe part (not shown) that is not integrally a part of the inspection chamber. This allows for incorporating the inspection chamber in a pipe structure without having to cut a hole in an existing pipeline for inspection in the pipeline. The optimized inspection chamber is thus not an "add-on", but rather a compartment for inspection and a pipe integrally connected in a single piece entity. A compartment 13 is between the pipe part 11 and the entrance opening 2, and is formed by wall portions 14 which extend from the pipe part 11 to the entrance opening 2.

Although other embodiments are conceivable, the embodiments shown in the Figures have at least two pipe connecting parts 13 sharing one axis. Preferably, as also shown, each of the at least two feet 4*a*, 4*b* extend in a direction which is across that axis. This provides for good stability when the inspection chamber is in the upright position.

Another embodiment entails a so-called "end-chamber" which has only one pipe-connection part.

The pipe part 11 of the inspection chamber 1 ideally functions such that it causes no undesired change in the flow profile of a flow through that pipe part 11, for instance relative to flow profiles in pipe parts which are not an integral part of an inspection chamber, i.e., pipe parts which are connected up with the pipe connection parts 12 of the inspection chamber 1. For that reason, pipe part 11 of the inspection chamber is on its outside provided with ribs 14, known in the art, for adding stiffness to the pipe-part 11. This is helpful for situations wherein groundwater pressure is high, and there is due to that a tendency to deform the pipe-part 11.

The inspection chamber is further preferably provided with stiffening portions 16 which form a direct connection between the feet-structure 4 and the wall portions 14. The stiffening portions 16 are preferably such that forces at least partly bypass the pipe part 11. Each of the stiffening portions 16 is supporting at least one of the multitude of positions 10 for abutting the rim 9 of the other inspection chamber when the feet-structure 4 is placed in the mating position of that inspection chamber. Accordingly, the pipe part 11 of the inspection chamber 1 is to an extent protected against deformation due to high forces exerted upon the feet-structure or exerted on the compartment 13 of the inspection chamber, or the walls thereof. Such high forces can to an extent be guided along the pipe part 11, in that sense bypassing pipe part 11. Thus, excessive deformation of pipe part 11 is avoided, to the benefit of maintenance of a flow pattern of a fluid running through the pipe part 11.

FIG. 4 shows an optimal way of positioning two inspection chambers in a mating position, in the sense that the stiffening portions 16 of the upper inspection chamber are positioned directly in line with the stiffening portions 16 of the lower inspection chamber, further ensuring that forces resulting from loading are as much as possible unaffecting the pipe part 11, so that also in a stacked position during transport or storage of inspection chambers, any deformation of the pipe part 11 is unlikely to occur.

It is further to be noted that in the position as shown of FIG. 4, any high forces which potentially could lead to ovality of the opening entrance in a direction across the axis of the pipe part 11, will be suppressed by the feet-structure 4 of the lower inspection chamber, as the feet-structure will counteract a tendency of parts of the inspection entrance that will experience any forces radially inwardly, for instance due to radially outwardly directed forces exerted on rim 9 by stiffening portions 16.

Preferably, as illustrated, a stiffening rib 17 is present between feet 4*a*, 4*b* of feet-structure 4, so as to assist in such counteracting forces which are directed radially inward.

Although it should be clear from FIG. 4 that stacking as shown is optimal, it is of course not inconceivable that the upper and lower inspection chambers are rotated relative to each other around an axis that coincides with the axis of the entrance opening.

The invention is not limited by the Figures shown in the drawings and as described in the description above. Although the feet-structure is shown to consist of two feet which are spatially separated from each other, it is equally possible that three or four feet are used, and/or that any of the feet are connected, for instance for providing more positions 10 against which the rim 9 of the other inspection chamber can abut in the mating position.

To highlight aspects of the invention from a different angle, the following numbered paragraphs provide further disclosure of the present subject-matter.

1. Inspection chamber for a pipe-structure for drainage or sewerage, the chamber having an inspection entrance at a first side for connection up with an inspection shaft, the chamber further being provided with a feet-structure at a second side, the first side and the second side being opposite sides of the inspection chamber, the inspection chamber comprising between the feet-structure and the inspection entrance a pipe-part, and between the pipe-part and the opening a compartment that is formed by wall-portions which extend from the pipe-part to the entrance opening, wherein the chamber is further provided with stiffening portions which form a direct connection between the feet-structure and the wall portions.

2. Inspection chamber according to para 1, wherein the stiffening portions by-pass the pipe-part.

3. Inspection chamber according to para. 1 or 2, wherein the feet structure comprises at least two feet which are in combination configured for maintaining a manufactured shape of the inspection entrance of another one of such an inspection chamber when the feet-structure is placed in a mating position with the inspection entrance of that other one of such an inspection chamber, for instance, during storage and/or transport thereof.

4. Inspection chamber according to para. 1, 2 or 3, wherein the inspection entrance for connecting up an inspection shaft lies in an imaginary plane, and wherein each of the feet comprises a base plate extending in a direction that is substantially parallel to that imaginary plane.

5. Inspection chamber according to any one of paras. 1-4, wherein each of the feet comprises a base plate extending in a direction that is across an axial direction of the entrance opening.

6. Inspection chamber according to any one of paras. 1-5, wherein the inspection entrance comprises a rim and wherein the inspection chamber is provided with a multitude of positions for abutting the rim of that another one of such an inspection chamber when the feet-structure is placed in the mating position.

7. Inspection chamber according to para. 6 wherein each of the multitude of positions is distributed so as to maximize a distance between those positions along the rim of that another one of such an inspection chamber when the feet-structure is in a mating position.

8. Inspection chamber according to para. 6 or 7, wherein the stiffening portions extend in a direction away from the pipe-part and are designed such that each stiffening portion is supporting at least one of the multitude of positions for abutting the rim of that another one of such an inspection chamber when the feet-structure is placed in a mating position.

9. Inspection chamber according to any one of paras. 1-8, wherein in the mating position at least a part of the feet-structure is within the inspection entrance of that another one of such an inspection chamber.

10. Inspection chamber according to any one of paras. 1-9, wherein the at least two feet are in combination configured for stabilizing the inspection chamber when positioned on the supporting ground in such a way that the inspection entrance is at an upper position, therewith hindering sideways falling of the inspection chamber.

11. Inspection chamber according to any one of paras. 3-10, wherein each foot itself is configured for resisting sinking of the inspection chamber into a sandy ground when positioned on such a sandy ground in such a way that the inspection entrance is at an upper position.

12. Inspection chamber according to any one of paras. 4-11, wherein at least one of the base plates extends over an area that corresponds to 5 to 40% of an area defined by the inspection entrance.

13. Inspection chamber according to any one of paras. 4-12, wherein each of the base plates extends over an area that corresponds to 5 to 40% of an area defined by the inspection entrance.

14. Inspection chamber according to any one of paras. 4-13, wherein each of the base plates has an edge that would cover a part of an inner periphery of the inspection entrance of that other one of such an inspection chamber, when in mating position.

15. Inspection chamber according to para. 14, wherein the part of the periphery of the inspection entrance that would be covered by an edge of the respective base plate when a mating position applies, corresponds to 10 to 45% of the entire inner periphery of the inspection entrance.

16. Inspection chamber according to any one of paras. 3-15, wherein at least one of the feet is provided with at least one position-holder configured for resisting lateral movement in at least one direction from a position of the inspection chamber in a sandy ground when the inspection chamber is positioned in such a way that the inspection entrance is at an upper position.

17. Inspection chamber according to para. 16, wherein the at least one position-holder is configured to resist lateral movement in any direction.

18. Inspection chamber according to para. 16 or 17, wherein the at least one position-holder comprises a blade-shaped part that extends in at least a direction that is parallel to an axial direction of the inspection entrance.

19. Inspection chamber according to any one of the previous paras., wherein the inspection chamber has at least two pipe connecting parts which are each for connecting up with a pipe part.

20. Inspection chamber according to para. 19, wherein two of the at least two pipe connecting parts share one axis.

21. Inspection chamber according to any one of the previous paras. as far as depending on para. 20, wherein each of the at least two feet extends in a direction which is across the direction of that axis.

22. Inspection chamber according to any one of the previous paras., wherein the feet-structure consists of two feet which are spatially separated from each other.

23. Inspection chamber according to any one of the preceding paras., wherein the at least two feet are equally distributed with respect to a periphery of the inspection entrance.

24. Stack of at least two inspection chambers for a pipe-structure for drainage or sewerage, each chamber having at a first side of the respective inspection chamber an inspection entrance for connecting up with an inspection shaft, each inspection chamber at a second side of the respective inspection chamber being provided with a feet-structure, the first side and the second side being opposite sides, each inspection chamber comprising between the feet-structure and the entrance opening a pipe-part, and between the pipe-part and the entrance opening a compartment that is formed by wall-portions which extend from the pipe-part to the entrance opening, wherein each inspection chamber is further provided with stiffening portions which form a direct connection between the feet-structure and the wall portions, wherein the feet-structure of one of the at least two inspection chambers is in a mating position with the inspection entrance of another one of the at least two inspection chambers, the feet-structure comprising at least two feet which in combination are configured for maintaining the manufactured shape of the inspection entrance of that another one of the at least two inspection chambers.

25. Stack according to para. 24, wherein the stiffening portions bypass the pipe-part.

26. Stack of at least two inspection chambers for a pipe-structure for drainage or sewerage, each chamber having at a first side of the respective inspection chamber an inspection entrance for connecting up with an inspection shaft, each inspection chamber at a second side of the respective chamber being provided with a feet-structure, the first side and the second side being opposite sides, wherein the feet-structure of one of the at least two inspection chambers is placed in a mating position with the inspection entrance of another one of the at least two inspection chambers, wherein the feet-structure of each inspection chamber comprises at least two feet which are in combination configured for stabilizing the respective inspection chamber when positioned on a supporting ground in such a way that the inspection entrance is at an upper position, therewith hindering sideways falling of the inspection chamber.

27. Stack according to any one of paras. 24-26, wherein each foot itself is configured for resisting sinking of the respective inspection chamber into a sandy ground when positioned on such a sandy ground in such a way that the inspection entrance is at an upper position.

28. Stack according to any one of paras. 24-27, wherein the inspection entrance for connecting up an inspection shaft lies in an imaginary plane, and wherein each of the feet comprises a base plate extending in a direction that is parallel to the imaginary plane.

29. Stack according to any one of paras. 24-28, wherein each of the feet comprises a base plate extending in a direction that is across an axial direction of the entrance opening.

30. Stack according to any one of paras. 24-29, wherein the inspection entrance comprises a rim and wherein the inspection chamber is provided with a multitude of positions for abutting the rim of that another one of such an inspection chamber when the feet structure is placed in the mating position.

31. Stack according to para. 30, wherein each of the multitude of positions is distributed so as to maximize a distance between those positions along the rim of that another one of such an inspection chamber when the feet structure in a mating position.

32. Stack according to paras 30 or 31, wherein the stiffening portions extend in a direction away from the pipe-part and are designed such that each stiffening portion is supporting at least one of the multitude of positions for abutting the rim of that another one of such an inspection chamber.

33. Stack according to any one of paras. 24-32, wherein at least a part of the feet-structure of the one of the inspection chambers is within the inspection entrance of that another one of such an inspection chamber.

34. Stack according to any one of paras. 26, 27 or 28, wherein at least one of the base plates extends over an area that corresponds to 5 to 40% of an area defined by the inspection entrance.

35. Stack according to any one of paras. 26 or 27, wherein each of the base plates extends over an area that corresponds to 5 to 40% of an area defined by the inspection entrance.

36. Stack according to any one of paras. 26 or 27, as far as dependent on para. 27 or 28, wherein each of the base plates has an edge of which dimensions cover a part of an inner periphery of the inspection entrance.

37. Stack according to para. 36, wherein the part of the periphery of the inspection entrance that would be covered by an edge of the respective base plate when a mating position applies, corresponds to 10 to 45% of the entire inner periphery of the inspection entrance.

38. Stack according to any one of paras. 26-37, wherein at least one of the feet is provided with at least one position-holder configured for resisting lateral movement in at least one direction from a position of the inspection chamber in a sandy ground when the inspection chamber is positioned in such a way that the inspection entrance is at an upper position.

39. Stack according to para. 38, wherein the at least one position-holder is configured to resist lateral movement in any direction.

40. Stack according to para. 38 or 39, wherein the at least one position-holder comprises a blade-shaped part that extends in at least a direction that is parallel to an axial direction of the inspection entrance.

41. Stack according to any one of the previous paras. 24-40, wherein the inspection chamber has at least two pipe connecting parts which are each for connecting up with a pipe part.

42. Stack according to para. 41, wherein two of the at least two pipe connecting parts share one axis.

43. Stack according to any one of the previous paras. 26-42, wherein each of at least two feet extends in a direction which is across the direction of that axis.

44. Stack according to any one of the previous paras. 24-43, wherein the feet-structure consists of two feet which are spatially separated from each other.

45. Stack according to any one of the preceding paras. 24-44, wherein the at least two feet are equally distributed with respect to a periphery of the inspection entrance.

The invention claimed is:

1. Inspection chamber for a pipe structure for drainage or sewerage, the chamber having an inspection entrance at a first side for connecting up with an inspection shaft, the chamber further being provided with a feet-structure at a second side, the first side and the second side being opposite sides of the inspection chamber, the feet-structure comprising at least two feet which are in combination constructed and arranged to:

stabilize the inspection chamber when positioned on a supporting ground in such a way that the inspection entrance is at an upper position, therewith hindering sideways falling of the inspection chamber; and maintain a manufactured shape of an inspection entrance of another one of such an inspection chamber when the feet-structure is placed in a mating position with the inspection entrance of that other one of such an inspection chamber;

and of which each foot itself is constructed and arranged to:

resist sinking of the inspection chamber into a sandy ground when positioned on such a sandy ground in such a way that the inspection entrance is at an upper position, wherein the inspection entrance for connecting up with an inspection shaft lies in an imaginary plane, and wherein each of the feet comprises a base plate extending in a direction that is parallel to that imaginary plane, and wherein at least one of the base plates extends over an area that corresponds to 5 to 40% of an area defined by the inspection entrance and/or at least one of the base plates has an edge that would cover a part of an inner periphery of the inspection entrance of that other one of such an inspection chamber, when in the mating position.

2. The inspection chamber according to claim 1, wherein each of the feet comprises a base plate extending in a direction that is across an axial direction of the entrance opening.

3. The inspection chamber according to claim 1, wherein each of the base plates extends over an area that corresponds to 5 to 40% of an area defined by the inspection entrance.

4. The inspection chamber according to claim 1, wherein the part of the periphery of the inspection entrance that would be covered by an edge of the respective base plate when the mating position applies, corresponds to 10 to 45% of the entire inner periphery of the inspection entrance.

5. The inspection chamber according to claim 1, wherein at least one of the feet is provided with at least one position-holder configured for resisting lateral movement in at least one direction from a position of the inspection chamber in a sandy ground when the inspection chamber is positioned in such a way that the inspection entrance is at an upper position.

6. The inspection chamber according to claim 5, wherein the at least one position-holder is configured to resist lateral movement in any direction.

7. The inspection chamber according to claim 5, wherein the at least one position-holder comprises a blade-shaped part that extends in at least a direction that is parallel to an axial direction of the inspection entrance.

8. The inspection chamber according claim 1, wherein the inspection entrance comprises a rim and wherein the inspection chamber is provided with a multitude of positions for abutting the rim of that another one of such an inspection chamber when the feet-structure is placed in the mating position.

9. The inspection chamber according to claim 8, wherein the positions of the multitude of positions is distributed along an outer periphery of each base plate, so as to maximize a distance between those positions along the rim of that another one of such an inspection chamber when the feet structure is put in the mating position.

10. The inspection chamber according to claim 1, wherein in the mating position at least a part of the feet structure is within the inspection entrance of that another one of such an inspection chamber.

11. The inspection chamber according to claim 1, wherein the chamber has at least one pipe connecting parts which are each for connecting up with a pipe part.

12. The inspection chamber according to claim 11, wherein the at least one pipe connecting part is at least two pipe connecting parts and two of the at least two pipe connecting parts share one axis.

13. The inspection chamber according to claim 12, wherein each of the at least two feet extends in a direction which is across that axis.

14. The inspection chamber according to claim 1, wherein the feet-structure consists of two feet which are spatially separated from each other.

15. The inspection chamber according claim 1, wherein the at least two feet are equally distributed with respect to a periphery of the inspection entrance.

16. The inspection chamber according to claim 1, wherein the inspection chamber comprises between the feet-structure and the inspection entrance a pipe-part, and between the pipe-part and the opening a compartment is formed by wall portions which extend from the pipe-part to the entrance opening.

17. The inspection chamber according to claim 16, provided with stiffening portions which form a direct connection between the feet-structure and the wall portions.

18. The inspection chamber according to claim 17, wherein the stiffening portions by-pass the pipe-part.

19. The inspection chamber according to claim 18, wherein the stiffening portions supports at least one of the multitude of positions for abutting the rim of that another one of such an inspection chamber when the feet-structure is placed in the mating position.

* * * * *